US006106375A

United States Patent [19]

Furusawa

[11] Patent Number: 6,106,375

[45] Date of Patent: Aug. 22, 2000

[54] APPARATUS FOR PROCESSING WASTE LIQUID AND WASTE GAS IN POLISHING DEVICE

[76] Inventor: Shiro Furusawa, 2647, Hayakawa, Ayase-shi, Japan

[21] Appl. No.: 09/296,908

[22] Filed: Apr. 22, 1999

[30] Foreign Application Priority Data

May 6, 1998 [JP] Japan ..... 10-123336

[51] Int. Cl.[7] ..... B24B 7/00; B01D 43/00

[52] U.S. Cl. ..... 451/67; 451/88; 451/442; 210/539; 210/540

[58] Field of Search ..... 451/64, 67, 87, 451/88, 285, 286, 287, 288, 289, 290, 442; 210/188, 539, 540; 55/417

[56] References Cited

U.S. PATENT DOCUMENTS 3,939,078 2/1976 Servas et al. .
3,996,027 12/1976 Schnell et al. .
4,157,903 6/1979 Kanda et al. .
4,869,779 9/1989 Acheson .
5,384,989 1/1995 Shibano .
5,407,378 4/1995 Shank, Jr. ..... 451/38

FOREIGN PATENT DOCUMENTS 9-262767 10/1997 Japan .

*Primary Examiner*—Timothy V. Eley
*Attorney, Agent, or Firm*—Snell & Wilmer, L.L.P.

[57] ABSTRACT

A processing apparatus for efficiently discharging both polishing liquid flowing out a surface plate and mist of polishing liquid produced through polishing with the use of simple measures, is composed of a drain receiver which is provided in proximity with the outer periphery of the surface plate, and which serves as both recovery means for recovering the polishing liquid flowing out from the surface plate and a suction means for sucking up the mist of polishing liquid produced through polishing, a common discharge pipe connecting the drain receiver to a gas-liquid separating mans, for simultaneously transferring both polishing liquid and mist of polishing liquid into the gas-liquid separating means therefrom, and a suction pump and a liquid processing means connected to the gas-liquid separating means.

15 Claims, 2 Drawing Sheets

APPARATUS FOR PROCESSING WASTE LIQUID AND WASTE GAS IN POLISHING DEVICE

FIELD OF THE INVENTION

The present invention relates to an apparatus for processing waste liquid and waste gas, and in particular an apparatus for processing and draining polishing liquid flowing out from a surface plate in a polishing device such as a lapping device or a polishing device, in which a workpiece is polished by the surface plate on rotation to which polishing liquid is fed, and venting mist of the polishing liquid produced through the polishing.

RELATED ART

In such a case that a semiconductor wafer is polished in a polishing device, the wafer is pressed against a surface plate for polishing while polishing liquid such as slurry of polishing materials or the like is fed to the surface plate on rotation. At this time, mist is produced due to splashing of the polishing liquid which is likely to pollute the work environment. Accordingly, measures for exhausting such mist have been prosperously used.

For example, Japanese Laid-Open Patent Publication No. H9-262767 discloses such an arrangement that a table dome is provided so as to cover the upper surface of a turntable (surface plate) while a waste liquid trough for receiving and draining polishing liquid dropping from the turntable is provided, and an exhaust duct is connected to the waste liquid trough so as to exhaust gas from the above-mentioned table dome through this exhaust duct.

However, in the above-mentioned conventional polishing device, a drain pipe for draining polishing liquid and an exhaust duct for exhausting mist are separately connected to a waste liquid trough so that the polishing liquid and the mist are drained and vented through different systems, respectively. Thus, both drain pipe and exhaust duct have to be laid in a narrow space around the turntable, and the pipe lines are tangled. Accordingly, a disadvantage of this polishing device is that the structure of the polishing device is complicated.

SUMMARY OF THE INVENTION

An object of the present invention is to provide an apparatus for processing waste liquid and waste gas, which can efficiently discharge polishing liquid flowing out from a surface plate and mist of polishing liquid produced through the polishing, with the use of simple measures in a polishing device for polishing a workpiece while the polishing liquid is fed onto the surface plate on rotation.

To that end, according to the present invention, there is provided a processing apparatus comprising a drain receiver serving as both recovery means for recovering polishing liquid flowing from a surface plate, and suction means for sucking mist of polishing liquid produced through polishing, a common discharge pipe for transferring both polishing liquid and mist of polishing liquid taken thereinto from the drain receiver into a gas-liquid separating means having a housing, for separating gas components and liquid components of the polishing liquid and the mist fed thereinto through the common discharge pipe, from each other within the housing due to a difference in weight between the gas and the liquid, a suction pump connected to an exhaust port of the gas-liquid separating means and a liquid processing means connected to a drain port of the gas-liquid separating means.

Further, according to a specific embodiment of the present invention, the above-mentioned drain receiver is composed of a channel member having a bottom surface and incorporating an opening which is opened in a ring-like shape along the outer periphery of the surface plate, the channel member being connected to the gas-liquid separating means through at least one discharge pipe connected to the bottom surface of the channel member.

Further, according to another specific embodiment of the present invention, the above-mentioned drain port of the gas-liquid separating means is opened at the same height as that of the bottom surface of the housing so that the separated liquid is autonomously drained, and the above-mentioned vent port of the gas-liquid separating means is opened at a position higher than the drain port so that only air can be selectively exhausted.

With the provision of the above-mentioned arrangement according to the present invention, after the polishing liquid and the mist of polishing liquid are simultaneously taken out from the drain receiver provided around the surface plate, both polishing liquid and mist of polishing liquid are led into the gas-liquid separating means through the common discharge pipe, and waste liquid and waste gas are separated from each other in this gas-liquid separating means and are then discharged. Thus, both polishing liquid and mist of polishing liquid can be simultaneously and efficiently discharged by a simple processing means having only one discharge system. Thus, the processing apparatus may have a simple structure, and there is no need of provision of a draining pipe line and a venting pipe line, separate from each other, in a narrow space around a surface plate, thereby it is possible to have a simple pipe line arrangement.

The present invention will be detailed in the form of preferred embodiments with reference to the accompanying drawings in which:

DESCRIPTION OF THE PREFERRED EMBODIMENT

Figure 1:
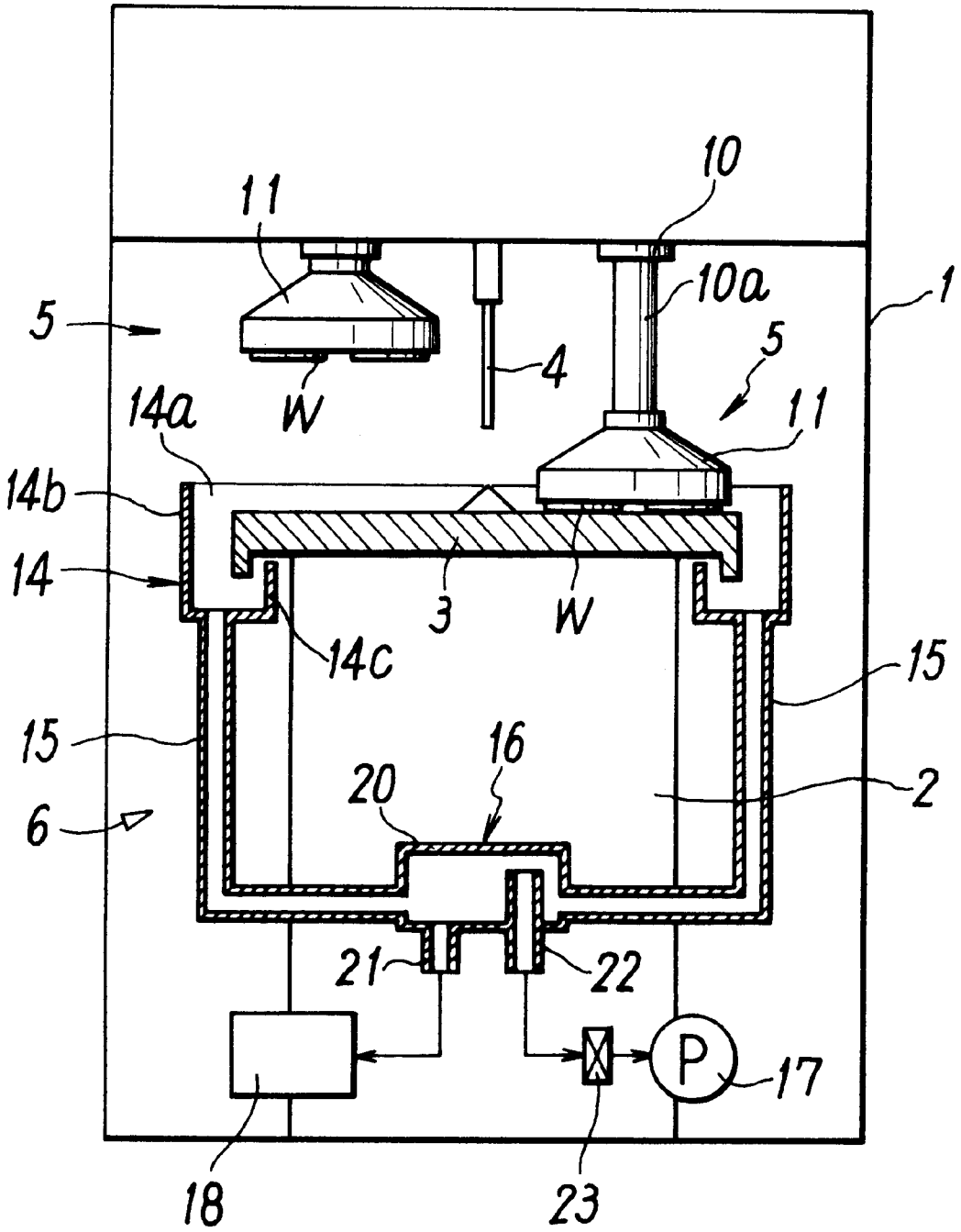
FIG. 1 is a front view illustrating an example of a polishing device incorporating a processing device according to the present invention.

Referring to FIG. 1 which shows a single surface polishing device for polishing one surface of a disc shape workpiece such as a semiconductor wafer or a magnetic disc substrate, as an example of a polishing device incorporating therein a processing apparatus for draining waste liquid and venting waste gas, according to the present invention, the polishing device is composed of a surface plate 3 which is rotatably arranged on a machine frame 2 so as to be driven by a drive motor which is not shown, a liquid feed nozzle 4 for feeding polishing liquid such as slurry of polishing materials to the surface plate 3, a pressing means 5 for pressing a workpiece W onto a pad surface on the surface plate 3, a processing apparatus 6 for processing and discharging the polishing liquid flowing out from the surface plate 3 and mist of polishing liquid produced through the polishing. These components are all accommodated in a casing 1.

The above-mentioned pressing means 5 comprises an air-cylinder 10, a pressure plate 11 rotatably attached to the lower end of a piston rod 10*a* of the air cylinder 10, and a work holding block (which is not shown) removably attached to the lower surface of the pressure plate 11. With this arrangement, the workpiece W bonded to the workpiece holding block is pressed against the pad surface on the surface plate 3 and is then polished.

The above-mentioned processing apparatus 6 incorporates a drain receiver 14 arranged in proximity with the outer periphery of the surface plate 3. This drain receiver 14 is composed of a channel member 14 incorporating an opening 14*a* opened in a ring-like shape along the outer periphery of the surface plate 3 so as serve as both recovery means for recovering polishing liquid flowing out from the surface plate 3 and suction means for sucking mist of polishing liquid. The drain receiver 14 may have a simple trough-like shape so that its inner and outer peripheral channel walls 14*c*, 14*b* having a substantially equal height, but preferably has such a cross-sectional shape that the outer peripheral channel wall 14*b* is extended to a position which is equal to or higher than the pad surface of the surface plate 3. However, the shape of this drain receiver 14 should not be limited to the shapes as mentioned above, but may have any shape if the polishing liquid and the mist of polishing liquid can be taken thereinto simultaneously.

The above-mentioned drain receiver 14 is connected at its bottom part with a common discharge pipe 15 through which both polishing liquid and mist of polishing liquid which have been taken up can be simultaneously transferred, and a gas-liquid separating means 16 is connected to the distal end of the common discharge pipe 15, and is also connected thereto with a suction pump 17 and a liquid processing means 18. More than one of the discharge pipes 15 may be used.

The gas-liquid separating means 16 separates liquid and gas from each other due to the difference in weight therebetween. Gas-liquid separating means 16 comprises a housing 20 connected to discharge pipe 15. The housing 20 is formed with a waste liquid drain port 21 opened to the inside of the housing 20 at a height substantially equal to the bottom surface of the same so as to allow the position liquid to autonomously flow out, and a waste gas vent port 22 opened to the inside of the housing 20 at a height higher than the drain port 21 so as to selectively discharge only air. The drain port 21 is connected to a waste liquid tank, a liquid purifying device or the like, and the vent port 22 is connected to a suction pump 17 directly, or through a filter 23.

When the workpiece W is polished by the polishing device having the above-mentioned arrangement, polishing liquid is fed onto the pad surface of the surface plate 3 on rotation from the liquid feed nozzle 4, and the workpiece W which is held by the pressing means 5 is pressed against the pad surface of the surface plate 3.

At this time, the polishing liquid having been used for processing flows into the drain receiver through the outer periphery of the surface plate 3, and further mist produced through polishing is sucked into the drain receiver 14 by the suction pump 17. Then, the polishing liquid and the mist taken in the drain receiver 14 is led through the common discharge pipe 15 and into the gas-liquid separating means 16, and are then separated into liquid and gas due to a difference in weight therebetween within the housing 20 of the gas-liquid separating means 16. Then, the liquid which is heavier than the gas autonomously flows through the drain port 21 opened at the low level and into the liquid processing means 18 while the air which is lighter is forcibly discharged through the vent port 22 by means of the suction pump 17.

Thus, after the polishing liquid and the mist of polishing liquid are simultaneously taken from the drain receiver 14, they are led through the common discharge pipe 15 and into the gas-liquid separating means 16 where they are separated into liquid and gas which are then discharged. Accordingly, with the use of only one discharge system, both polishing liquid and mist of polishing liquid can be processed and discharged. Thus, the arrangement of the processing device 6 can be simplified, and accordingly, it is possible to eliminate the necessity of the provision of a drain pipe and a vent pipe, separate from each other, thereby it is possible to simplify the arrangement of the pipe line.

Figure 2:
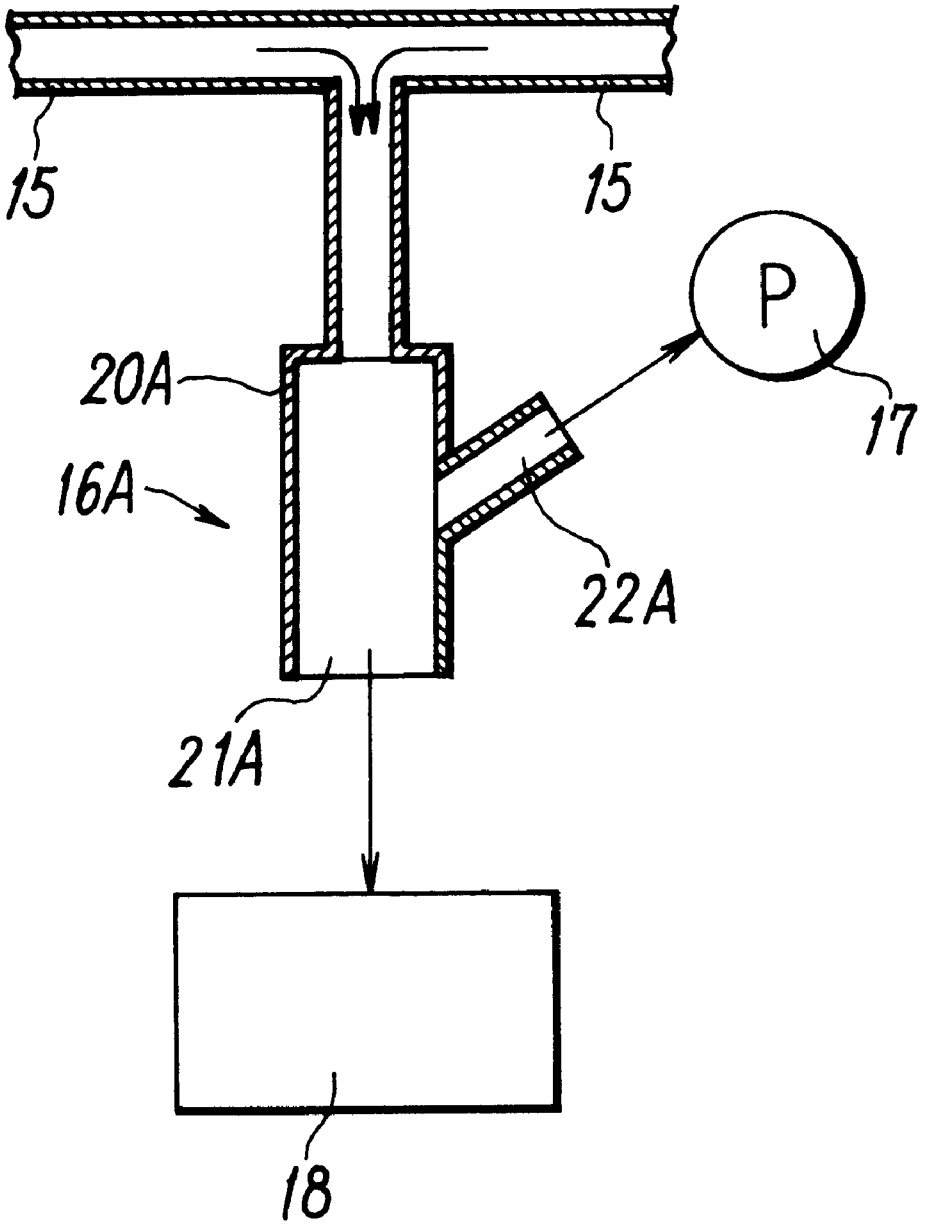
FIG. 2 is a front view illustrating an essential part of a gas-liquid separating means in a different example.

Referring to FIG. 2 which shows another example of the gas-liquid separating means, the gas-liquid separating means 16A of this second example has a cylindrical housing 20A having in its lower end part a waste liquid drain port 21A and in its side surface a waste gas vent port 22A which upward branches from the housing 20A, and is opened at a position higher than the drain port 21A. On the contrary, the gas-liquid separating means 16 shown in FIG. 1 has a box-like housing 20 and the drain port 21 and the vent port 22 which are opened at different heights above the bottom surface of the housing 20.

Although it has been explained in the embodiment shown that the present invention is applied in the single surface polishing device as a polishing device, the present invention should not limited to this device, but may be applied to a double surface polishing device for polishing both surfaces of a workpiece W or an outer periphery polishing device for polishing a chamfered outer peripheral edge of a workpiece W.

Thus, according to the present invention, polishing liquid flowing out from the surface plate 3 and mist of polishing liquid produced by polishing can be surely and efficiently discharged by a simple means having only one discharge system provided around the surface plate.

What is claimed is:

1. An apparatus for polishing a workpiece while a polishing liquid is fed to said workpiece, wherein a waste liquid and a waste mist are produced during polishing, said apparatus comprising:

a polishing plate, having a peripheral edge, configured to polish said workpiece;

a drain receiver adjacent said peripheral edge of said plate and configured to receive said waste liquid and said waste mist from said plate;

at least one common discharge conduit connected to said drain receiver; and a separator connected to said common discharge conduit and configured to receive and separate said waste liquid and said waste mist, said separator comprising:

(a) a housing, (b) a drain port connected to said housing and configured to drain said waste liquid from said separator, and (c) a vent port connected to said housing and configured to vent said waste mist from said separator.

2. The apparatus of claim 1 further comprising:

a suction pump operatively connected to said vent port; and a liquid processor connected to said drain port and configured to receive said waste liquid drained from said separator.

3. The apparatus of claim 1 wherein said drain receiver comprises a channel concentrically surrounding said peripheral edge of said plate and having: (a) an annular opening concentrically surrounding said peripheral edge of said plate and configured to receive said waste liquid and said waste mist, and (b) a bottom surface connected to said common discharge pipe.

4. The apparatus of claim 1 wherein:

said drain port is connected to said housing at a first location and is configured to allow said waste liquid to autonomously drain therethrough; and said vent port is connected to said housing at a second location spaced apart from said first location, said vent port comprising an opening positioned at a height higher than said drain port.

5. The apparatus of claim 1 wherein:

said housing comprises a bottom portion;

said drain port is connected to said bottom portion and is configured to allow said waste liquid to autonomously drain therethrough; and said vent port is connected to said housing at a position higher than said drain port so that said waste mist can be selectively discharged.

6. A workpiece polishing device comprising a surface polishing plate having a peripheral edge and configured to polish a workpiece while a polishing liquid is fed to said polishing plate, wherein a waste liquid and a waste mist are produced during polishing, said polishing device further comprising an apparatus for processing said waste liquid and said waste mist, wherein said apparatus comprises:

a drain receiver adjacent said peripheral edge of said surface plate and concentrically surrounding said surface plate and configured to receive said waste liquid and said waste mist;

at least one common discharge pipe having a first end connected to said drain receiver and configured to receive said waste liquid and said waste mist from said drain receiver; and a gas-liquid separator connected to a second end of said common discharge pipe and configured to receive and separate said waste liquid from said waste mist, said separator comprising:

(a) a housing, (b) a drain port connected to said housing and configured to allow said waste liquid to drain from said gas-liquid separator, and (c) a vent port connected to said housing and configured to allow said waste mist to exit from said gas-liquid separator.

7. The workpiece polishing device of claim 6 further comprising:

a suction pump operatively connected to said vent port and configured to draw said waste mist from said polishing plate and into said vent port; and a liquid processor connected to said drain port.

8. The workpiece polishing device of claim 6 wherein said drain receiver comprises an annular channel member concentrically surrounding said peripheral edge of said surface polishing plate and having: (a) an annular opening concentrically surrounding said peripheral edge of said surface polishing plate and configured to receive said waste liquid and said waste mist, and (b) a bottom surface connected to said first end of said common discharge pipe.

9. The workpiece polishing device of claim 6 wherein:

said housing comprises a bottom surface;

said drain port is connected to said bottom surface and is configured to allow said waste liquid to autonomously drain therethrough; and said vent port is connected to said bottom surface, said vent port comprising an opening disposed above said drain port so that said waste mist can be selectively discharged.

10. The workpiece polishing device of claim 6 wherein:

said housing comprises a bottom portion;

said drain port is connected to said bottom portion and is configured to allow said waste liquid to autonomously drain therethrough; and said vent port is connected to said housing at a position higher than said drain port so that said waste mist can be selectively discharged.

11. An apparatus for processing waste liquid and waste gas from a workpiece polishing device, which comprises a surface polishing plate having a peripheral edge and configured to polish a workpiece while a polishing liquid is fed to said surface plate, wherein a waste liquid and a waste mist are produced during polishing and wherein said apparatus comprises:

a drain receiver adjacent said peripheral edge of said surface plate and concentrically surrounding said surface plate and configured to receive said waste liquid and said waste mist;

at least one common discharge pipe having a first end connected to said drain receiver and a second end and configured to receive said waste liquid and said waste mist from said drain receiver; and a gas-liquid separating means connected to said second end of said at least one common discharge pipe and configured to receive and separate said waste liquid and said waste mist and comprising:

(a) a housing, (b) a drain port connected to said housing and configured to allow said waste liquid to drain from said gas-liquid separator, and (c) a vent port connected to said housing and configured to allow said waste mist to exit from said gas-liquid separator.

12. The apparatus of claim 11 further comprising:

a suction pump operatively connected to said vent port; and a liquid processing means connected to said drain port.

13. The apparatus of claim 11 wherein said drain receiver comprises an annular channel member concentrically surrounding said peripheral edge of said surface polishing plate and having: (a) an annular opening concentrically surrounding said peripheral edge of said surface polishing plate and configured to receive said waste liquid and said waste mist, and (b) a bottom surface connected to said first end of said at least one common discharge pipe.

14. The apparatus of claim 11 wherein:

said housing comprises a bottom surface;

said drain port is connected to said bottom surface and is configured to allow said waste liquid to autonomously drain therethrough; and said vent port is connected to said bottom surface and opened at a height higher than said drain port so that said waste mist can be selectively discharged.

15. The apparatus of claim 11 wherein:

said housing comprises a bottom portion;

said drain port is connected to said bottom portion and is configured to allow said waste liquid to autonomously drain therethrough; and said vent port is connected to said housing at a position higher than said drain port so that said waste mist can be selectively discharged.

* * * * *